US006453491B1

(12) United States Patent
Wells et al.

(10) Patent No.: US 6,453,491 B1
(45) Date of Patent: Sep. 24, 2002

(54) SAFETY BED HAVING RELEASABLE GUARD RAIL ASSEMBLY

(76) Inventors: James Wells, 101 N. Marvine Ave., Auburn, NY (US) 13021; Joseph H. Hallock, 30 W. Main St., Earlville, NY (US) 13332; Gregg Weinschreider, 3635 English Ave., Morrisville, NY (US) 13408

( * ) Notice: Subject to any disclaimer, the term of this patent is extended or adjusted under 35 U.S.C. 154(b) by 0 days.

(21) Appl. No.: 09/829,593

(22) Filed: Apr. 10, 2001

(51) Int. Cl.[7] ..... A47C 21/08
(52) U.S. Cl. ..... 5/430; 5/100
(58) Field of Search ..... 5/430, 93.1, 100, 5/428, 425, 600

(56) References Cited

U.S. PATENT DOCUMENTS

| | | | | | |
|---|---|---|---|---|---|
| 321,649 | A | * | 7/1885 | Shelley | 5/100 |
| 2,866,983 | A | * | 1/1959 | Rose | 5/99.1 |
| 3,002,199 | A | * | 10/1961 | Galloway | 5/100 |
| 3,093,838 | A | * | 6/1963 | Beasley | 5/100 |

FOREIGN PATENT DOCUMENTS

| | | | | |
|---|---|---|---|---|
| DE | 2909747 | * | 9/1980 | 5/430 |
| GB | 181852 | * | 6/1922 | 5/100 |

* cited by examiner

*Primary Examiner*—Alexander Grosz
(74) *Attorney, Agent, or Firm*—Wall Marjama & Bilinski

(57) ABSTRACT

A safety bed includes a wooden bed frame which supports a mattress, a footboard attached to one lateral side of said support structure, a headboard disposed at an opposing end of said support structure, and a pair of lateral side rails interconnecting the footboard and the headboard on opposing sides of the bed frame. A guard rail adapter includes at least one guard member that extends over the entire length of one side of said bed frame, the guard rail member including an upper end and a lower end. Each of the upper and lower ends of the guard members are releasably attached to the bed frame, the lower end of the guard rail member being pivotally attached to the bed frame such that the guard rail member can pivot between a first raised position and a second lowered position relative to the bed frame to prevent a patient from injury. Once the adapter is removed, the bed can assume the role and appearance of a typical standard or twin-size bed.

19 Claims, 3 Drawing Sheets

SAFETY BED HAVING RELEASABLE GUARD RAIL ASSEMBLY

FIELD OF THE INVENTION

This invention relates to the field of safety beds, and more particularly to a safety bed having an adaptively releasable guard rail assembly.

BACKGROUND OF THE INVENTION

Safety beds are repletely well known and described in the field, such as those which are commonly found in certain medical and geriatric facilities. Generally, these beds include a guard rail assembly which can be raised to prevent the patient from falling out of the bed and lowered to allow the patient ingress and egress from the bed. Known guard rail assemblies, such as those described in U.S. Pat. No. 5,742,959, typically include a top and a bottom horizontal rail as well as a series of spaced vertical bars therebetween. Such assemblies are therefore a lattice type of structure having a number of associated gaps. Other safety or guard rail assemblies for cribs, such as described in U.S. Pat. No. 5,926,870, have similarly "gapped" structures.

In spite of fairly strict governmental standards that have been specifically mandated for the construction of safety beds, there have been numerous reported instances in which a patient has fallen not only through gaps in a guard rail assembly, but also between other gaps often created between the lateral side of the mattress and box spring and the guard rail assembly, and between various portions of the bed frame itself. These injuries can not only be traumatic but also catastrophic, producing entrapment and possibly death. Therefore, there is an urgent need in the fields to provide a safety bed which all but eliminates the probability of such injuries as those described above.

A safety bed may not only be required in a hospital or other similar facility, but also in a home care environment. The guard rail assemblies of all known safety beds, however, are typically nonremovable or at a minimum not easily removable from the bed frame. In addition, such assemblies do not readily blend into the decor of a typical bedroom. Therefore, there is a similar need to provide a safety bed which is more conducive to a home-like setting, wherein the safety bed can more closely resemble, for example, a standard or a twin size bed.

SUMMARY OF THE INVENTION

It is a primary object of the present invention to overcome the above-noted problems of the prior art.

It is a further primary object of the present invention to provide a safety bed for a medical facility, a geriatric facility, or the like which insures that a patient will not become trapped between a guard rail and any other portion of the bed or bed frame.

Therefore and according to a preferred aspect of the present invention, there is provided a guard rail adapter for a safety bed, said safety bed including a frame for supporting a mattress, said guard rail adapter including:

at least one guard member, said at least one guard member being sized to extend over an entire lateral side of said frame and including an upper end and a lower end;

means for releasably attaching said guard member to the bed frame, said releasable attaching means including hinge means for hingably attaching the lower end of the guard member to the bed frame, wherein said guard member can selectively pivotally move between a first raised position and a second lowered position, such that when in the first position the guard member is in compressive contact with a lateral side of the mattress to minimize the existence of gaps between the bed frame, the guard member, and the mattress, and when the guard member is in the second position permits a patient ingress and egress from said bed.

Preferably, the guard member includes a plurality of transparent windows between the upper end and the lower end which permits a physician or other caregiver to monitor the patient while in a sitting position when the guard member is in the first or raised position.

The guard rail adapter can be separably removable from the safety bed. Moreover, the guard member is preferably made from the same material (e.g., wood) as the bed frame to make the bed more compatible in appearance with a standard, a twin-size or other size bed, such as those intended for ordinary home use.

According to another preferred aspect of the invention, there is provided a safety bed comprising:

a bed frame, said bed frame including a footboard, a headboard, and side rails interconnecting said footboard and said headboard on opposing lateral sides of the bed frame;

a mattress fitted onto said bed frame; and a guard rail adapter, said adapter including:

at least one guard member, said guard member extending over the entire length of one side of said bed frame and including an upper end and a lower end; and means for releasably attaching the upper end and the lower end of said guard rail adapter to the bed frame, said releasable attaching means including hinge means for hingably attaching the lower end of the guard rail adapter to the bed frame, said guard member being pivotal between a first position and a second position relative to said bed frame wherein the first position places the upper end of the guard member above an upper surface of the mattress and in compressive contact with a lateral side thereof to prevent gaps between the guard member, the bed frame and the mattress and the second position places the upper end of the guard member beneath the upper surface of the mattress to permit ingress and egress from said bed.

Preferably, the safety bed will function and appear as a standard, twin-size or other size bed when the adapter is removed therefrom, the guard rail adapter being made from a similar material as the bed frame (e.g., wood) such that the safety bed maintains an appearance which is more conducive to a home environment.

An advantage of the present invention is that the guard member when secured in the first position will prevent the patient from falling out of the bed, while also preventing or at least substantially minimizing the incidence of "gap-related" injuries which can occur using standard known guard rail assemblies. The present guard rail adapter and the safety bed using same are in compliance with the strict governmental standards which are required for facility safety beds.

A further advantage of the present invention is that the guard member is easily movable between the first and second position for a care giver, but not for the patient. In addition, the adapter easily be removed from the bed frame without requiring tools or intensive labor or modifications.

These and other objects, features, and advantages will be readily apparent from the following Detailed Description which should be read in conjunction with the accompanying drawings.

DETAILED DESCRIPTION

The following description relates to a safety bed design according to a specific embodiment. It will be readily apparent from the following discussion, however, that certain variations and modifications can easily be imagined within the inventive concepts as claimed herein. Furthermore, certain terms are used throughout this discussion such as "upper", "lower", "lateral", and the like which assist in providing a frame of reference with regard to the accompanying drawings. These terms, however, should not necessarily be construed as limiting of the present invention, except as otherwise stated herein.

Figure 1:
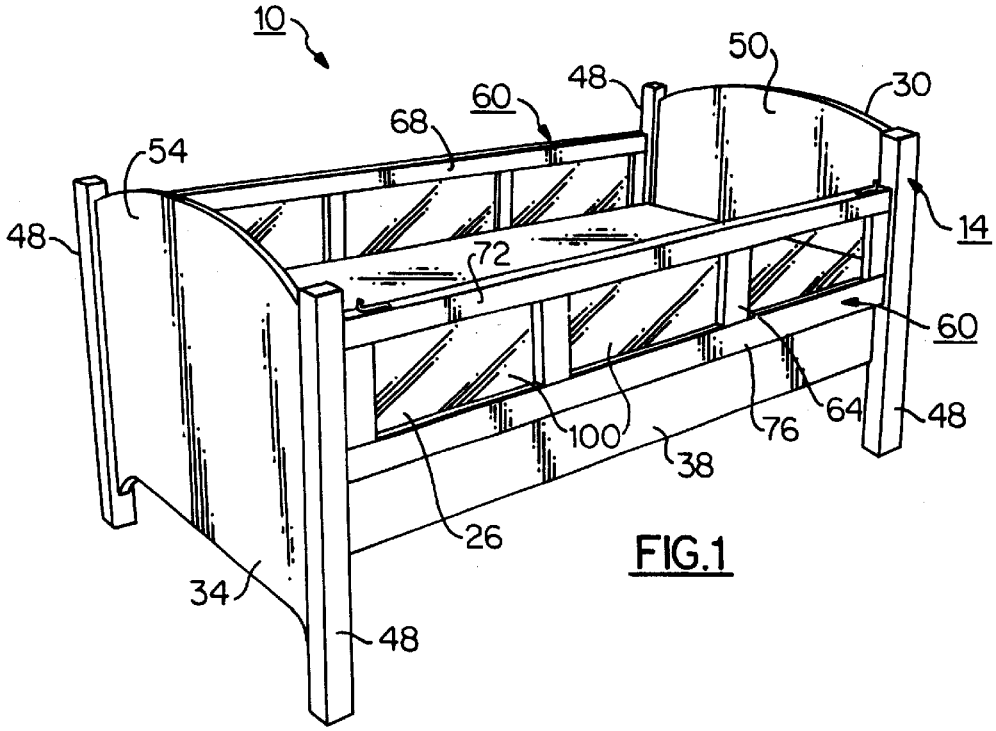
FIG. 1 is a side perspective view of a safety bed including a guard rail adapter made in accordance with a preferred embodiment of the present invention, the guard rail adapter having a guard member disposed in a first or raised position.

Referring to FIG. 1, there is illustrated a safety bed 10 in accordance with the preferred embodiment of present invention. The safety bed includes a wooden bed frame 14, the frame including a headboard 30, a footboard 34, and a pair of side rails 38 (only one of which is shown in FIG. 1), which interconnect the headboard and the footboard. The bed frame 14 and each of the preceding components collectively define a supporting structure for a stacked mattress 26 and box spring (not shown). Each of the headboard 30 and footboard 34 extend above an upper surface 46 of the mattress 26, the headboard 30 and footboard 34 each including a pair of bed posts 48 which are secured to a unitary member 50, 54, respectively, the posts being secured thereto using conventional furniture fastening techniques, such as a knockdown fitting having an eccentric cam so as to reduce forward play in each of the interconnected components.

Figure 2:
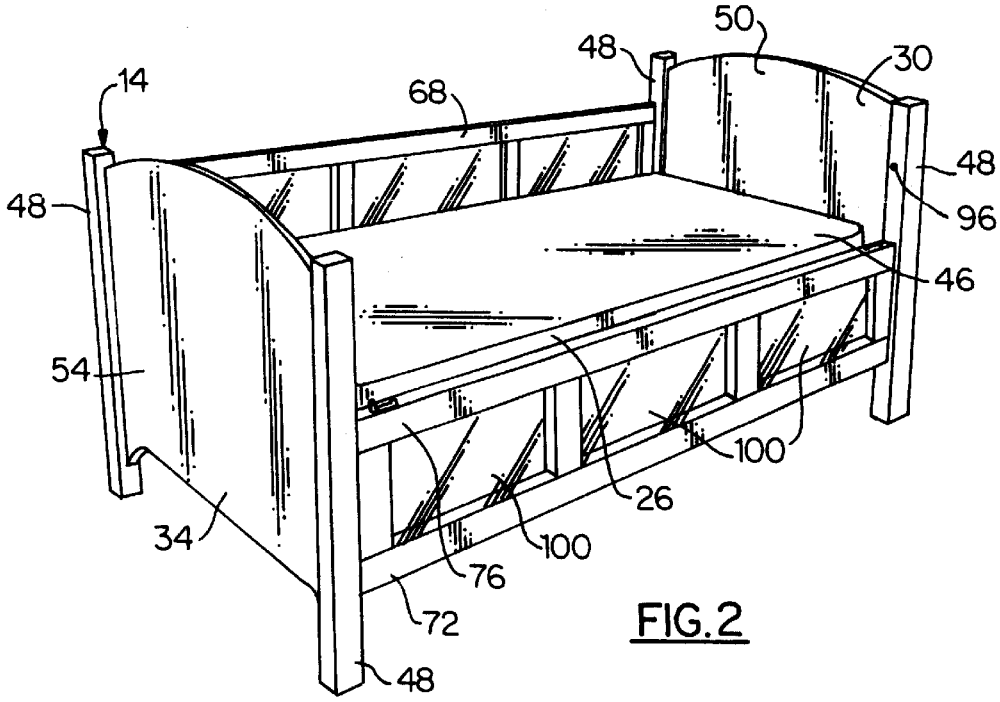
FIG. 2 is a side perspective view of the safety bed of FIG. 1, depicting the guard member of the guard rail adapter in a second or lowered position.

Referring to FIGS. 1 and 2, a guard rail adapter 60 according to the preferred embodiment includes a pair of guard members, 64, 68, each of the guard members being disposed on an opposing lateral side of the bed frame 14. For purposes of the discussion which follows, only details specific to one of the guard members 64 are provided, though it should be understood that the remaining guard member 68 is identical in appearance and function.

More specifically, and referring to FIGS. 1–5, the guard member 64 includes an upper end 72 and a lower end 76, the guard members being substantially planar members made from wood having a grain preferably like that of the bed frame 14. The guard member 64 is sized to occupy the entirety of the lateral space between the footboard 34 and the headboard 30; that is, the length of a side rail 38 without any gaps therebetween.

A locking member 80 extends from respective opposing sides of the upper end 72 and the lower end 76 of the guard member 64 for engagement with a corresponding number of openings 96 which are provided in the bed posts 48. For purposes of this embodiment, the locking members 80 are pins housed within openings provided in each of the upper end 72 and the lower end 76 of the guard member 64, the pins being preferably though not necessarily biased into a deployed position by means of a spring 88. Each of the locking members 80 can be retracted by means of a lever 90 which is connected to one end of each locking member, the lever being movable to a inset position along an L-shaped slot 84 which retracts the pin to a unlocked slot position 94. It will be readily apparent to one of ordinary skill in the field that other release mechanisms can be utilized to unlock either the upper and/or lower end 72, 76 and should not be limited by the specific mechanism described herein. Moreover, and in conjunction with the openings 96, a strike plate (not shown) could be added to each of the bed posts 48, the strike plate having a ramped slot extending to the opening 96, such that the upper end 72 of the guard member 64 can be aligned relative to the openings 96 laterally mounted to the bed frame 14 without first having to retract the locking members 80 in assembly.

The guard member 64 has a corresponding height dimension such that the upper end 72 of the member can pivot about the lower end 76 between a first or raised position, such as shown in FIG. 1, and a second or lowered position, such as shown in FIG. 2. The axis defining the pivot axis of the lower end 76 is stationary throughout the pivoting action, this axis always being beneath the upper surface 46 of the mattress 26. Each of the first and second positions assumable by the guard member 64 as shown in FIGS. 1 and 2, respectively, are substantially in the same lateral plane as the side rail 38.

Each of the guard members 64, 68 include a set of transparent windows 100 made from Plexiglas, polycarbonate, or other suitable material, the windows being disposed between the upper and lower ends, 72, 76, and permitting a care giver to monitor a resting patient from a sitting position without having to first look over the guard member 64. Though three windows are shown, any number of windows can be provided; for example, a single window (not shown) extending over the length of the guard member 64 could be substituted.

Referring to the FIGS. in general and in operation, the guard member 64 is herein first described as attached to the bed frame 14 and in the first position assumed in FIG. 1. In this raised position, the patient (not shown) cannot fall out of the bed in that the upper end 72 of the guard member 64 is substantially above the upper surface 46 of the mattress 26. Furthermore, because the guard member 64 extends along the entire lateral side of the bed frame 14 and includes no gaps, either within the guard member itself or between the lateral side of the mattress 26 and the guard member, the risk of injury is greatly minimized.

Retraction of each of the locking members 80 located at the upper end 72 of the guard rail adapter 60 is accomplished by pulling each of the levers 90 against the bias of springs 88 and placing the lever 90 within respective unlocked slot positions 94, thereby releasing the upper end and permits the guard rail member 64 to pivot downwardly about the lower end 76 from the first position, shown in FIG. 1, to the second position, as shown in FIG. 2. In this lowered position, the patient (not shown) can easily get into and out of the bed as needed.

Figure 3:
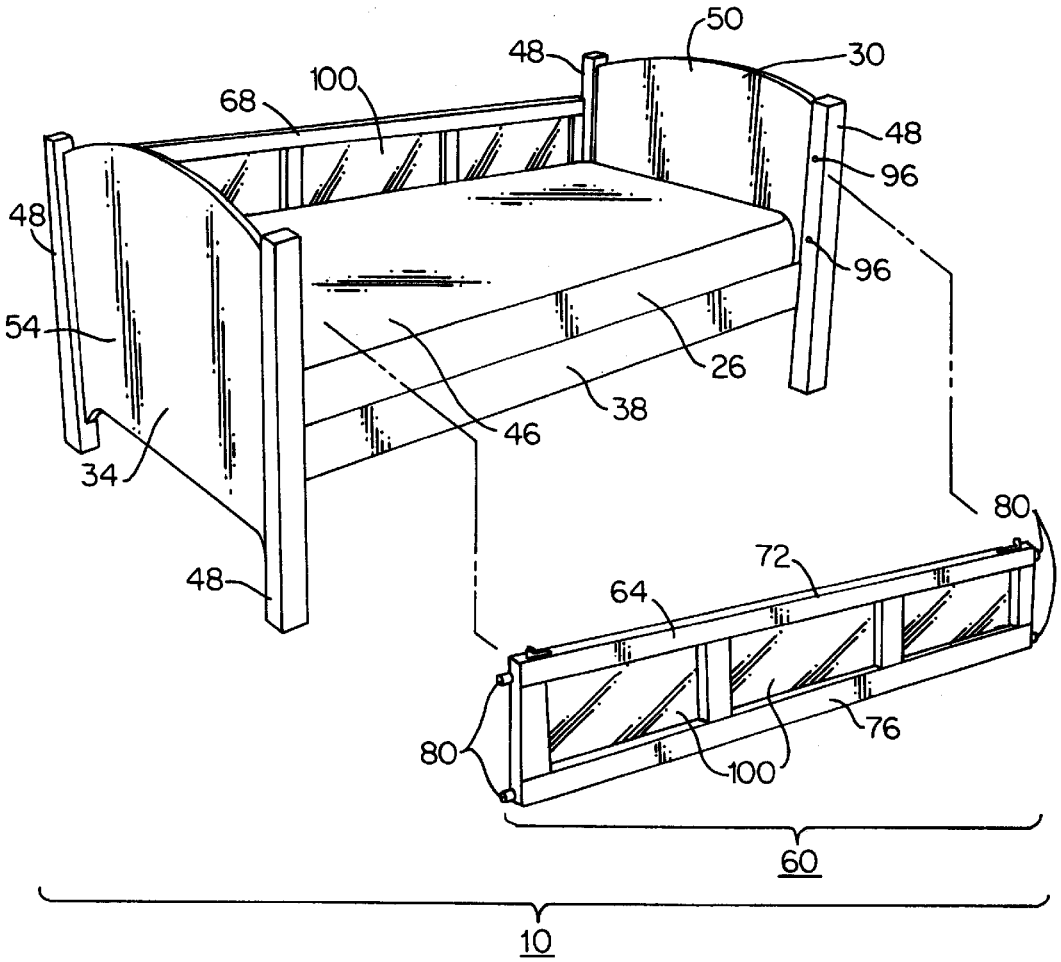
FIG. 3 is the side perspective view of the safety bed of FIGS. 1 and 2, with the guard rail adapter removed from the safety bed.
Figure 4:
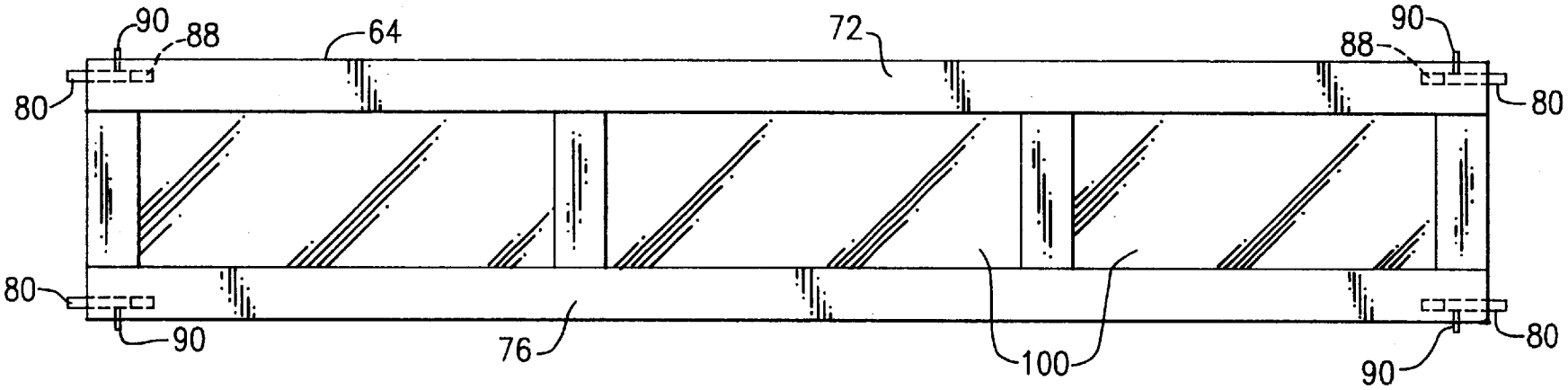
FIG. 4 is a side view of one of the guard members depicted in FIGS. 1–3.
Figure 5:
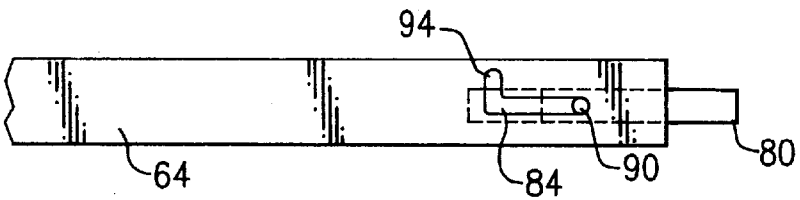
FIG. 5 is an enlarged partial top view of the locking mechanism for the guard member of FIGS. 1–4.

In order to remove the guard rail adapter 60 from the bed frame 14 from the first position, FIG. 1 the guard member 64 is first pivoted to the second position, FIG. 2, as described above, by releasing the locking members 80 at each opposing side of the upper end 72. Once the member 64 has been pivoted, the locking members 80 at the lower end 76 of the guard member 64 can also be retracted in a similar manner by pulling each of the levers 90 against the biasing of springs 88 to unlock the lower end and remove the guard member from the bed frame 14, as shown in FIG. 3. Though not shown, guard member 68 can be similarly removed. As noted and upon removal of the guard rail adapter 60, the safety bed 10 looks no different than a standard twin size bed and can be used for that purpose.

PARTS LIST FOR FIGS. 1–5

10 safety bed
14 bed frame
26 mattress
30 headboard
34 footboard
38 side rail
46 upper surface
48 bedposts
50 unitary member-headboard
54 unitary member-footboard
60 guard rail adapter
64 guard member
68 guard member
72 upper end
76 lower end
80 locking member
84 slots
88 spring
90 lever
94 unlocked slot position
96 openings
100 windows Though the present invention has been described in terms of a preferred embodiment, it will be readily apparent that other modifications and variations are possible. For example, other mechanisms can be utilized in conjunction with the guard rail adapter to releasably maintain the adapter to the bed frame. In addition, fascia (not shown) could be provided to cancel the lever 90 from the patient while still providing adequate access for the caregiver.

We claim:

1. A releasably attachable guard rail adapter for a safety bed, said safety bed including a wooden frame comprising a headboard and a footboard disposed at opposing ends of said frame in relation to a supported mattress and a pair of side rails interconnecting the footboard and the headboard, said guard rail adapter including:

at least one guard member, made substantially of a rigid material, said at least one guard member when assembled to said bed frame extending over the entire length of one side of said frame, said at least one guard member including an upper end and a lower end;

means for releasably attaching the upper and lower ends of said at least one guard member to the frame, said releasably attaching means including hinge means for hingably attaching the lower end of said guard member to the frame, such that said at least one guard member can selectively pivot between a first position and a second position by releasing the attachment of the upper end of said guard member, wherein said at least one guard member is substantially planar with the side rails of the frame in each of the first and second positions, wherein said at least one guard member when in the first position is in substantial compressive contact with a lateral side of the mattress such that there are no gaps between the frame and the lateral side of the supported mattress and between the guard member and the lateral side of the supported mattress, and in the second position permits ingress and egress from said safety bed.

2. A guard rail adapter as recited in claim 1, wherein said releasable attaching means further includes at least one engagement member extending from one of opposing lateral ends of the upper end of the guard member and bed frame for engagement with at least one corresponding opening in the other of said bed frame and guard member.

3. A guard rail adapter as recited in claim 2, including biasing means for biasing said at least one engagement member into a locking position.

4. A guard rail adapter as recited in claim 1, including two guard members, each of said guard members being releasably attachable to a corresponding lateral side of the safety bed.

5. A guard rail adapter as recited in claim 1, wherein each of said first and second positions assumable by said guard rail adapter are substantially within a lateral plane established by a side rail of the bed frame.

6. A guard rail adapter as recited in claim 1, including at least one transparent window which permits viewing of a patient while said guard member is in the first position.

7. A guard rail adapter as recited in claim 1, wherein said at least one guard member is substantially wooden.

8. A guard rail adapter as recited in claim 1 wherein the releasable attaching means includes a pair of engagement members extending from opposing lateral ends of the upper end of the guard member, said bed frame including means for laterally receiving said upper end without first requiring said engagement members to be retracted.

9. A guard rail adapter as recited in claim 1, wherein said hinge means are located below a top surface of said mattress to permit ingress and egress when said guard member is in the second position.

10. A safety bed comprising:

a bed frame, said frame defining a planar support structure and including a solid footboard attached to one end of said support structure, a solid headboard disposed at an opposing end of said support structure, and a pair of side rails interconnecting said footboard and said headboard on opposing lateral sides of the bed frame;

a mattress fitted within said bed frame, said headboard and said footboard each being solid unitary sections extending above a top surface of said supported mattress and each of said footboard and said headboard being in substantial compressive contact with a respective side of said supported mattress such that there are no gaps therebetween; and a guard rail adapter, said adapter including:

at least one rigid guard member, said guard member being substantially made from a rigid material extending over the entire length of one lateral side of said bed frame and including an upper end and a lower end;

means for releasably attaching each of the upper and lower ends of said guard adapter to the bed frame, said releasable attaching means including hinge means for hingably attaching the guard adapter to said bed frame such that the at least one guard member can pivot between a first position and a second position relative to said bed frame wherein said at least one guard member is substantially planar to said bed frame in each of said first and second positions and in which said first position places the upper end of the guard member above the upper surface of the mattress and the lower end in substantial compressive contact with a lateral side of said mattress such that there are no gaps between the guard member and the lateral side of the mattress and between the bed frame and the lateral side of the mattress and the second position places the upper end of the guard member beneath the top surface of the mattress to permit ingress and egress from said bed.

11. A safety bed as recited in claim 10, wherein said guard member includes at least one transparent window to permit viewing of a patient while the guard member is in the first position.

12. A safety bed as recited in claim 10, wherein said hinge means includes a retractable pin member provided in one of opposing lateral ends of said guard rail member and said bed frame for engaging a corresponding opening in the other of said bed frame and said lateral ends of said guard rail member.

13. A safety bed as recited in claim 10, wherein said first position and said second position are each planar relative to a side rail of said bed frame.

14. A safety bed as recited in claim 10, wherein said releasable attachment means includes at least one engagement member disposed in one of opposing lateral sides of the upper end of said guard rail member and said bed frame for engaging at least one corresponding opening disposed in the other of said bed frame and said guard rail member.

15. A safety bed as recited in claim 14, including biasing means for biasing said engagement member into a locked position.

16. A safety bed as recited in claim 10, wherein said bed frame is made from wood.

17. A safety bed as recited in claim 10, wherein said bed is a twin bed.

18. A safety bed as recited in claim 10, wherein the releasable attaching means includes a pair of engagement members extending from opposing lateral ends of the upper end of the guard member, said bed frame including means for laterally receiving said upper end without first requiring said engagement members to be retracted.

19. A safety bed as recited in claim 10, wherein said hinge means are located below a top surface of said mattress to permit ingress and egress when said guard member is in the second position.

* * * * *